US010631703B2

(12) United States Patent
Rhodes

(10) Patent No.: US 10,631,703 B2
(45) Date of Patent: Apr. 28, 2020

(54) BROOM COVER ATTACHMENT AND METHOD OF ITS USE

(71) Applicant: James Rhodes, Pittsburgh, PA (US)

(72) Inventor: James Rhodes, Pittsburgh, PA (US)

( * ) Notice: Subject to any disclaimer, the term of this patent is extended or adjusted under 35 U.S.C. 154(b) by 117 days.

(21) Appl. No.: 16/045,790

(22) Filed: Jul. 26, 2018

(65) Prior Publication Data

US 2020/0029777 A1 Jan. 30, 2020

(51) Int. Cl.
*A47L 13/14* (2006.01)
*A46B 17/08* (2006.01)
*A47L 13/44* (2006.01)

(52) U.S. Cl.
CPC ..... *A47L 13/44* (2013.01); *A46B 17/08* (2013.01); *A46B 2200/302* (2013.01); *A46B 2200/3026* (2013.01)

(58) Field of Classification Search
CPC ..... A47L 13/44; A47L 13/12; A47L 13/42; A46B 17/08; A46B 2200/302; A46B 2200/3026; A46B 15/0091
See application file for complete search history.

(56) References Cited

U.S. PATENT DOCUMENTS 960,158 A * 5/1910 Cummings ..... A47L 13/44 15/247
1,138,305 A * 5/1915 Miller ..... A47L 13/44 15/247
1,929,082 A * 10/1933 Simon ..... A47L 13/44 15/247
6,389,637 B1 * 5/2002 Hurell ..... A47L 13/20 15/228
6,745,434 B2 * 6/2004 Smith ..... A47L 13/20 15/104.94
2004/0158951 A1 * 8/2004 Smith ..... A47L 13/20 15/247
2009/0260174 A1 * 10/2009 Aldana ..... A46B 17/04 15/229.2
2014/0047655 A1 * 2/2014 Clayton ..... A47L 13/12 15/115

* cited by examiner

*Primary Examiner* — Dung Van Nguyen

(74) *Attorney, Agent, or Firm* — KA Filing LLC; Wayne V. Harper

(57) ABSTRACT

Embodiments of the present disclosure provide a broom cover attachment for attaching to a broom including a plurality of bristles. The broom cover attachment includes a handle attachment having a central unit, a hole in the central unit for receiving a handle of the broom, and a plurality of elastic bands attached to a surface between an outer circumference and an inner circumference of the central unit. Each of the plurality of elastic bands may include a first Velcro attachment. The broom cover attachment also includes a cloth including a number of second Velcro attachment attached to a surface of the cloth. The second Velcro attachments may be fastened to the first Velcro attachment of the elastic bands for covering the bristles of the broom.

20 Claims, 6 Drawing Sheets

300

BROOM COVER ATTACHMENT AND METHOD OF ITS USE

TECHNICAL FIELD

The presently disclosed subject matter generally relates to the field of cleaning devices. Particularly, the present subject matter relates to a broom cover attachment for attaching to a broom comprising a plurality of bristles.

BACKGROUND

Cleaning of places like houses, offices, etc. is an essential part of everyone's day-to-day life. There are various broom and cleaning devices available in the markets. The brooms are good for cleaning surfaces. Brooms usually have a plurality of bristles at an end and a handle extending outwards. The bristles cannot clean the minute dust from the hard surfaces properly. Further, for dusting and cleaning the hard surfaces, brooms are not sufficient and a cloth or a separate cleaning device may be required for dusting and wiping the hard surfaces.

There exist many "broom covers" and broom attachments in the market for cleaning hard surfaces that can be used with the brooms. The existing broom cover/broom attachment may comprise a cloth and an attachment usually made up of metal or rigid material for attaching to a broom. The base of the broom where the bristles are can be covered with the broom cover or broom attachment and the cloth of the broom cover/broom attachment may be used to clean dirt, dust and pet hair more effectively than a broom with bristles alone. Though the existing broom covers/broom attachments helps in effective cleaning of hard surfaces but they suffer from some limitations. Many of the existing broom attachments are fixed with a metal or other rigid material that may create limitations in the ability of the attachment to be cleaned. Some of the existing broom attachments are fixed with attachments, which make removing and replacing cleaning cloth attachment inconvenient. Other existing broom covers or broom attachments may not be adjustable to different size and shaped brooms.

In light of above discussion, there exists need for improved broom covers or broom attachments for use with existing brooms for cleaning, moping, and dusting of the hard surfaces.

SUMMARY

The present disclosure provides a broom cover attachment for use with existing brooms having a plurality of bristles.

The present disclosure provides a broom cover attachment configured to attach to a broom such that covering a number of bristles of the broom.

The present disclosure provides a method for using a broom cover attachment for covering a plurality of bristles of a broom.

The main objective of the present disclosure is to provide a broom cover attachment, which is easy to use with a broom existing in the art. The broom cover attachment comprises a substantially circular handle attachment comprising a hole and plurality of elastic bands wherein each having a first Velcro attachment and a cloth comprising a plurality of second attachments that can be fastened to the first Velcro attachments of the central module. A handle of the broom may be entered through a hole in the handle attachment and then the cloth may be attached to the handle attachment by fastening the second Velcro attachments to the first Velcro attachments of the handle attachment. The broom cover attachment is easy to attach to a base comprising a plurality of bristles of the broom. The broom cover attachment is easy to clean as it can be easily removed from the broom. The cloth or the handle attachment of the broom cover attachment may be easily replaced from the broom.

An embodiment of the present disclosure provides a broom cover attachment for attaching to a broom comprising a plurality of bristles. The broom cover attachment includes a handle attachment including a central unit, a hole in the central unit for receiving a handle of the broom, and a plurality of elastic bands attached to a surface between an outer circumference and an inner circumference of the central unit. Each of the plurality of elastic bands comprises a first Velcro attachment. The broom cover attachment also includes a cloth including a plurality of second Velcro attachment attached to a surface of the cloth. The plurality of second Velcro attachment is configured to be fastened to the first Velcro attachment of the plurality elastic bands for covering the plurality of bristles of the broom.

According to an aspect of the present disclosure, the central unit of the handle attachment is circular in shape.

According to an aspect of the present disclosure, a diameter i.e. a distance from a center of the hole to the outer circumference of the central unit is at least four inches.

According to an aspect of the present disclosure, a diameter of the hole is at least one and half inches for allowing a broom handle to enter through the hole.

According to an aspect of the present disclosure, the plurality of elastic bands comprises at least six elastic bands.

According to an aspect of the present disclosure, the cloth includes a microfiber cloth.

According to an aspect of the present disclosure, the plurality of second Velcro attachment comprises at least six second Velcro attachment attached to the surface of the cloth configured to enable an easy attachment and removal of the cloth from the handle attachment.

Another embodiment of the present disclosure provides a broom cover attachment for attaching to a broom comprising a plurality of bristles. The broom cover attachment comprising a handle attachment comprising a hole in a circular central unit for receiving a handle of the broom, and at least six elastic bands attached to a surface between an outer circumference and an inner circumference of the circular central unit, wherein each of the at least six elastic bands comprises a first attachment. The broom cover attachment also includes a microfiber cloth comprising at least six second attachments, the at least six second attachments are configured to be fastened to the first attachment of the plurality of elastic bands for covering the plurality of bristles of the broom.

According to an aspect of the present disclosure, a diameter of the circular central unit of the handle attachment is at least four inches.

According to another aspect of the present disclosure, the first attachment comprises at least one of a Velcro, one or more tying threads, and a button.

According to another aspect of the present disclosure, the second attachment comprises at least one of a Velcro, one or more tying threads, and a button.

Yet another embodiment of the present disclosure provides a method for using a broom comprising a plurality of bristles. The method includes providing a broom cover attachment comprising a handle attachment comprising a central unit, a hole in a center of the central unit, and a plurality of elastic bands attached to a surface between an outer circumference and an inner circumference of the handle attachment, wherein each of the plurality of elastic bands comprises a first attachment, and a cloth comprising a plurality of second attachment. The method also includes attaching the broom cover attachment to the broom by entering the handle of the broom in the hole and fastening the plurality of second attachment of the cloth to the first attachment of the plurality elastic bands such that the plurality of bristles of the broom are covered with the cloth.

Other and further aspects and features of the disclosure will be evident from reading the following detailed description of the embodiments, which are intended to illustrate, not limit, the present disclosure.

BRIEF DESCRIPTION OF THE DRAWINGS

The illustrated embodiments of the disclosed subject matter will be best understood by reference to the drawings, wherein like parts are designated by like numerals throughout. The following description is intended only by way of example, and simply illustrates certain selected embodiments of devices, systems, and processes that are consistent with the disclosed subject matter as claimed herein.

DETAILED DESCRIPTION

The following detailed description is made with reference to the figures. Exemplary embodiments are described to illustrate the disclosure, not to limit its scope, which is defined by the claims. Those of ordinary skill in the art will recognize a number of equivalent variations in the description that follows.

Figure 1A:
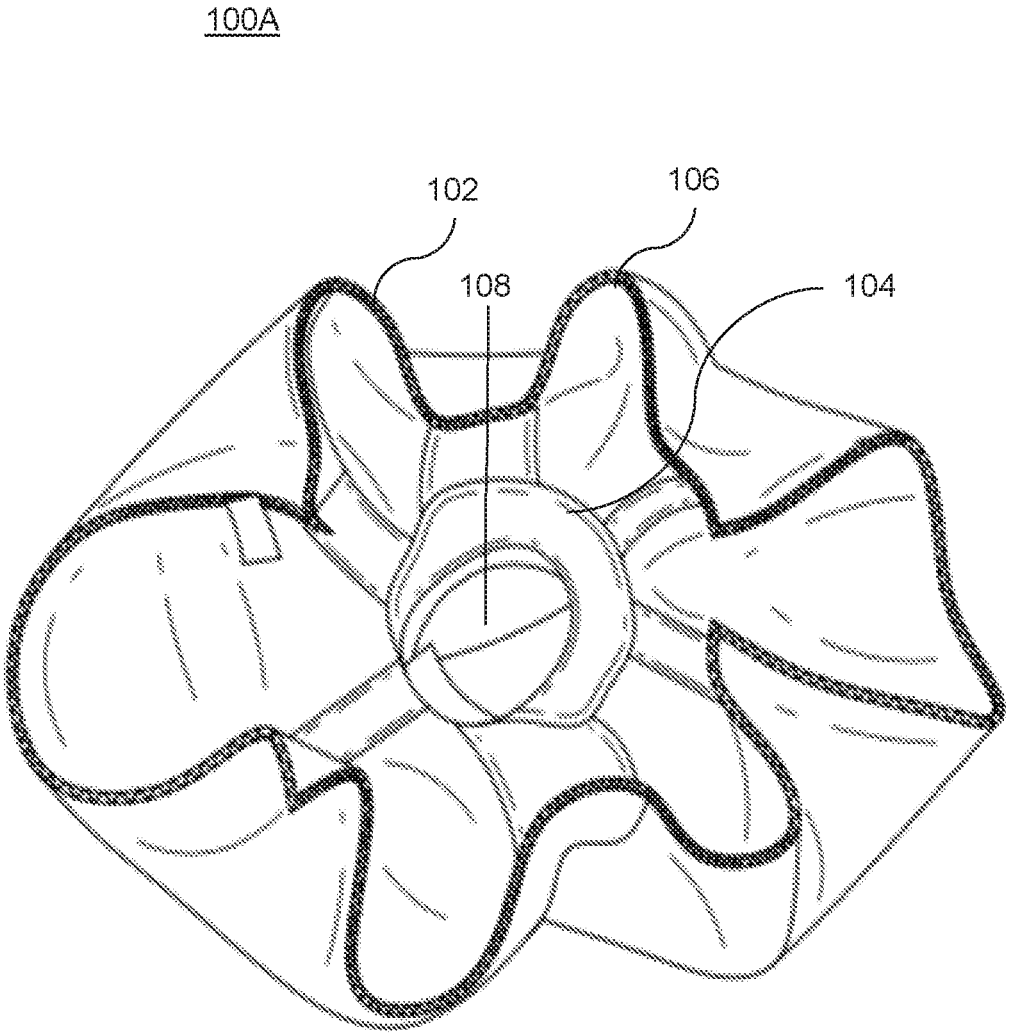
FIG. 1A-1C is a schematic diagram illustrating different views of an exemplary broom cover attachment, in accordance with various embodiments of the present disclosure.

FIG. 1A is a schematic diagram illustrating a side view 100A of an exemplary broom cover attachment 102 for use with a broom, in accordance with various embodiments of the present disclosure. Usually the broom includes a handle extending outwards and a plurality of bristles at an end of the broom. The broom cover attachment 102 primarily includes a handle attachment 104 having a central unit and a cloth 106. In alternative embodiments, the handle attachment 104 includes the central unit that may have any suitable regular or irregular shape such as, but not limited to, circular, a square, an oval, a rectangle, a triangle, etc.

Further, the handle attachment 104 includes a hole 108 in the central unit for receiving a handle of the broom. A diameter of the hole 108 is good enough to receive and accommodate the handle of the brooms existing in the art. In some embodiments, the diameter of the hole 108 is at least one and a half inches. Further, the handle attachment 104 may include multiple elongated bands projecting outwards from the central unit of the handle attachment 104. Each of the elongated bands may include a first attachment. In some embodiments, a length of each of the elongated elastic bands is at least four inches. Examples of the first attachment may include, but are not limited to, a Velcro, tying threads, a button, and so forth. The structure of the handle attachment 104 is described in detail with reference to FIG. 2.

The cloth 106 may be a microfiber cloth. The cloth 106 may have second attachments for attaching to the first attachment(s) of the handle attachment 104. The cloth 106 can be attached to the handle attachment 104 such that the plurality of bristles of the broom is covered entirely. Examples of the second attachments comprising, but not limited to, a Velcro, tying threads, a button, and so forth. After the bristles are covered with the cloth 106, the broom can be used to clean or mop the hard surfaces. The structure of the cloth 106 is described in detail with reference to FIG. 3.

The broom cover attachment 102 may not include any metal part, therefore the broom cover attachment 102 is long lasting and easy to use and replace, when required. Further, the broom cover attachment 102 may be easily cleaned as the cloth 106 can easily be removed from the handle attachment 104, and then handle attachment 104 comes out of the handle of the broom easily.

Figure 1B:
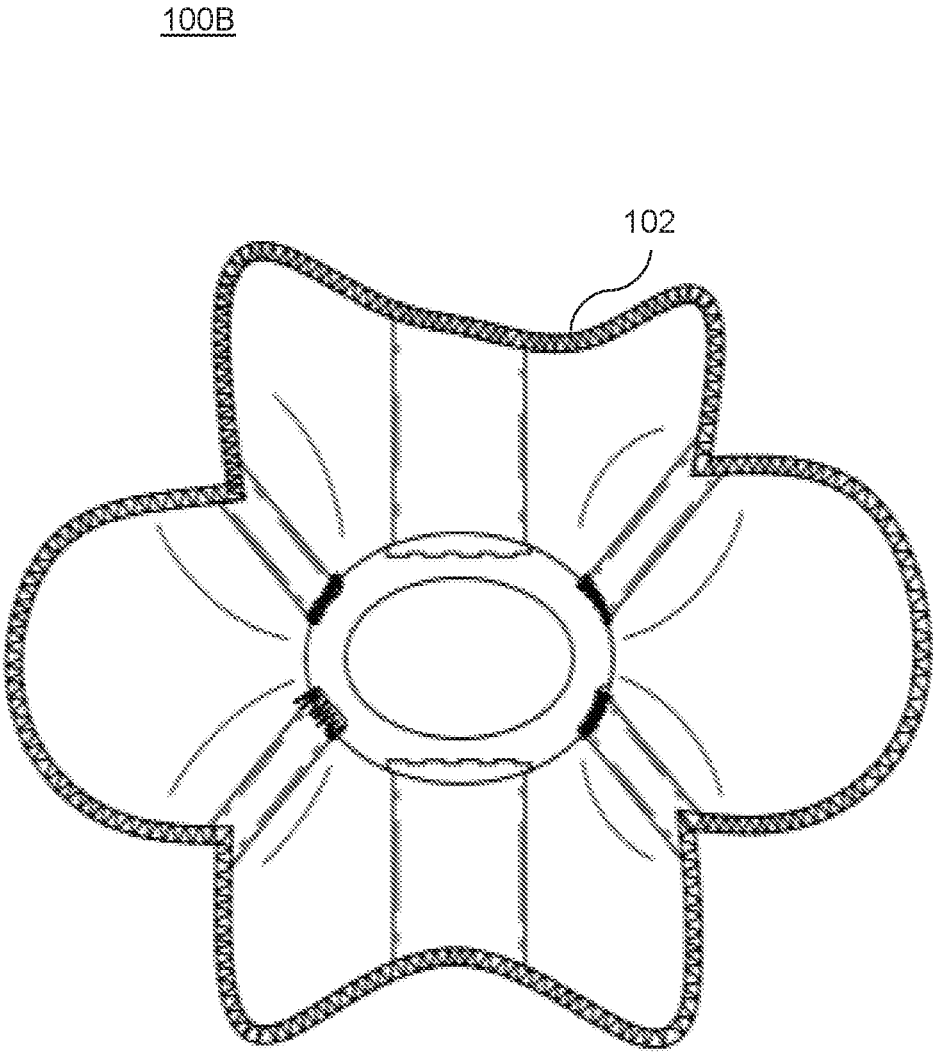
Figure 1C:
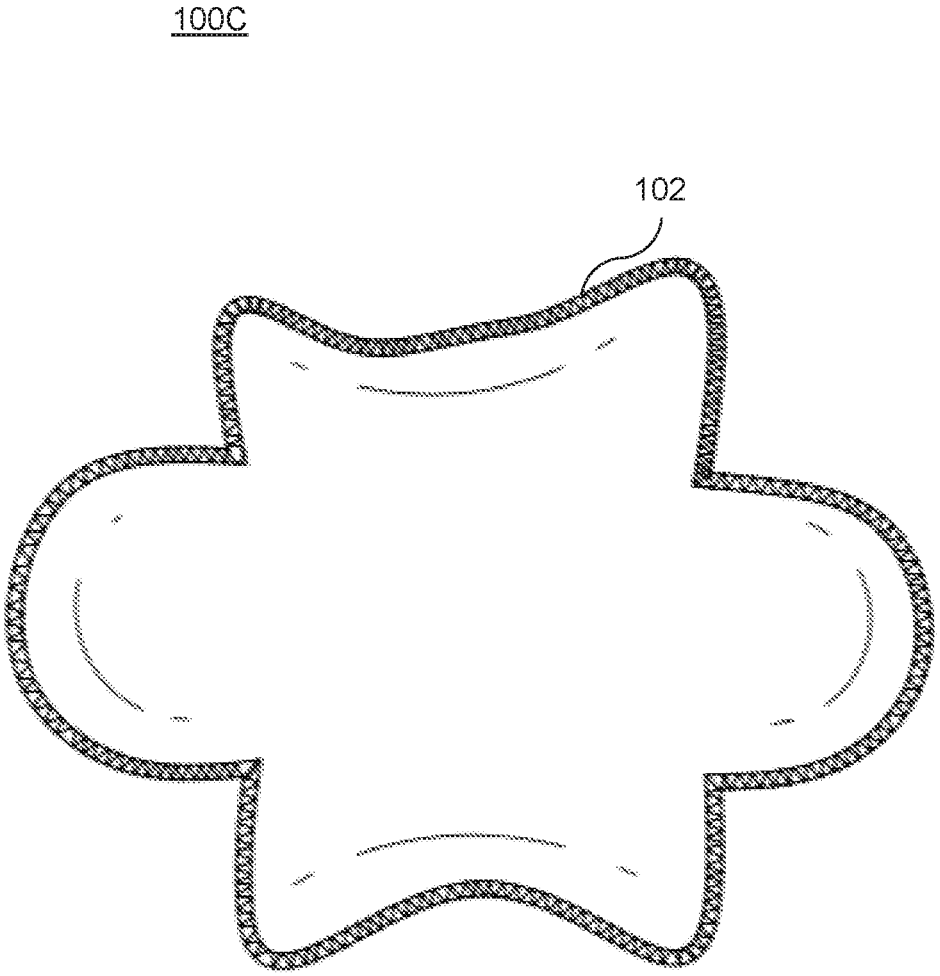

FIG. 1B is a schematic diagram illustrating a top view 100B of the exemplary broom cover attachment 102. The broom cover attachment 102 is flexible and may adapt to the shape of the bristles of the broom. FIG. 1C is a schematic diagram illustrating a back view 100C of the broom cover attachment 102. As shown, the base of the broom cover attachment 102 is made up of cloth such as, but not limited to, microfiber cloth that can cover the bristles of the broom.

Figure 2:
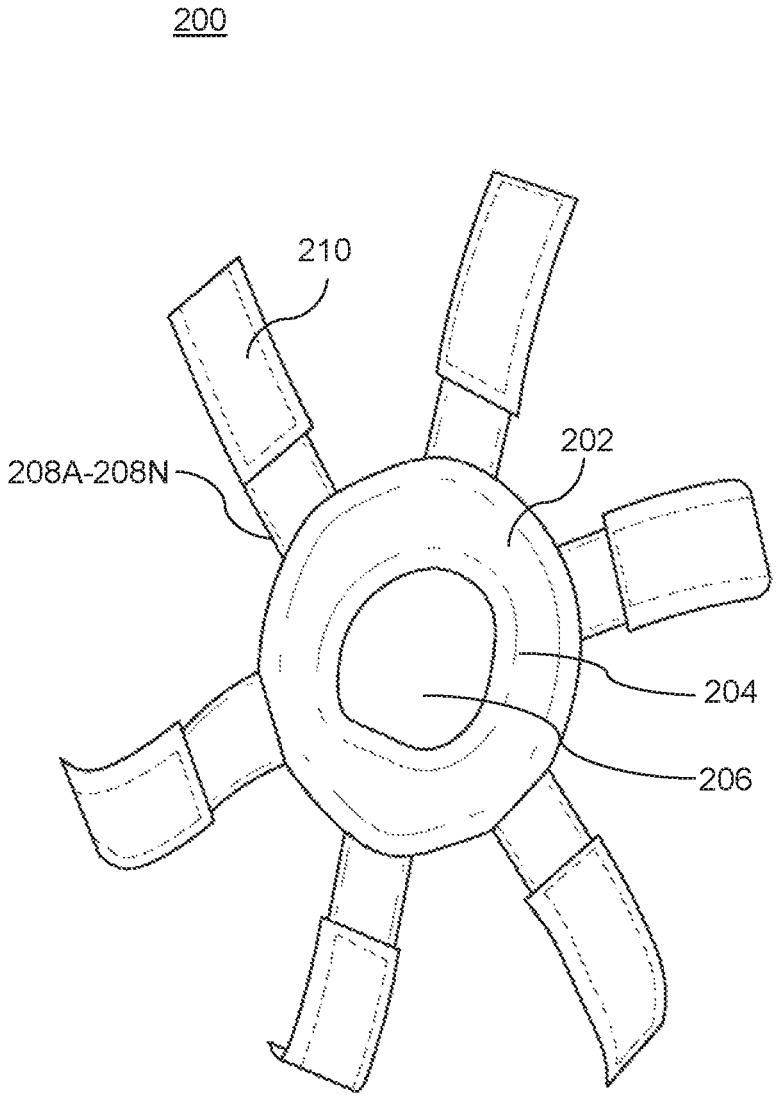
FIG. 2 is a block diagram illustrating a structure of a handle attachment of an exemplary broom cover attachment, in accordance with an embodiment of the present disclosure.

FIG. 2 illustrates an exemplary handle attachment 200 of an exemplary broom cover attachment, in accordance with an embodiment of the present disclosure. As discussed with reference to the FIG. 1, the handle attachment 200 is similar in structure and functionality to the handle attachment 104 of the broom cover attachment 102. The handle attachment 200 is made up of any suitable felt material, such as, but not limited to, cotton, nylon, etc. As shown, the handle attachment 200 includes a central unit 202. The central unit 202 comprises an outer circumference and an inner circumference and a surface 204 between the inner circumference and the outer circumference. Further, the central unit 202 of the handle attachment 200 may be circular in shape and may have a diameter. In some embodiments, the diameter of the central unit 202 is at least four inches. In alternative embodiments, the diameter of the central unit 202 may be more or less than four inches.

Further, the central unit 202 may be like a ring having a hole 206 in its center for receiving a handle of the broom. For example, a diameter from a center of the hole 206 to the outer circumference of the central unit 202 is at least four inches. The diameter of the hole 206 is at least one and half inches for allowing a broom handle to enter through the hole 206. This way, the handle attachment 200 may be attachment to the broom. Though not shown, but in some embodiments, the central unit 202 may have any regular or irregular shape comprising, but not limited to, a triangle, a square, a rectangle, a hexagon, a pentagon, an oval, and so forth. In some embodiments, a shape and diameter of the handle attachment 200 is in accordance with a shape and size of a handle of the broom.

Further, the handle attachment 200 includes a plurality of elastic bands 208A-208N attached to the surface 204 between an outer circumference and an inner circumference of the central unit 202. In some embodiments, the plurality of elastic bands 208A-208N includes at least six elastic bands, i.e. the handle attachment 200 includes six elastic bands 208A-208N. In some embodiments, a length of each of the plurality of elastic bands 208A-208N is at least four inches.

Each of the plurality of elastic bands 208A-208N comprises a first attachment 210. In some embodiments, the first attachment 210 includes a Velcro and hereinafter may be referred as a first Velcro attachment 210. Examples of the first attachment 210 may include, but are not limited to, a Velcro, tying threads, a button, and so forth. As discussed with reference to FIG. 1, the first Velcro attachment 210 can be attached to the cloth 106 via the plurality of second Velcro attachments covering the plurality of the bristles of the broom. A structure of the cloth 106 is described in detail with reference to FIG. 3.

Figure 3:
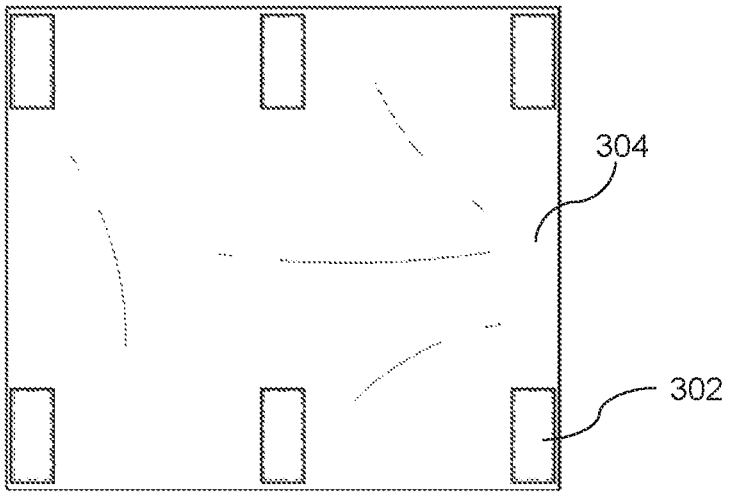
FIG. 3 is a block diagram illustrating a structure of a cloth of an exemplary broom cover attachment, in accordance with an embodiment of the present disclosure.

FIG. 3 illustrates an exemplary cloth 300 (or 106) of an exemplary broom cover attachment, in accordance with an embodiment of the present disclosure. The cloth 300 includes a plurality of second attachment 302 attached to a surface 304 of the cloth 300. Examples of the plurality of second attachment 302 may include, but not limited to, a Velcro, one or more tying threads, a button, and so forth. The plurality of second attachment 302 may be fastened to the first attachment 210 of the plurality elastic bands 208A-208N for covering a plurality of bristles of the broom. When the plurality of second attachment 302 is Velcro then it may be referred as the plurality of second Velcro attachment 302.

In some embodiments, the cloth 300 is a microfiber cloth. Further, the plurality of second Velcro attachment 302 includes at least six second Velcro attachment 302 attached to the surface 304 of the cloth 300 configured to enable an easy attachment and removal of the cloth 300 from the handle attachment 200.

Figure 4:
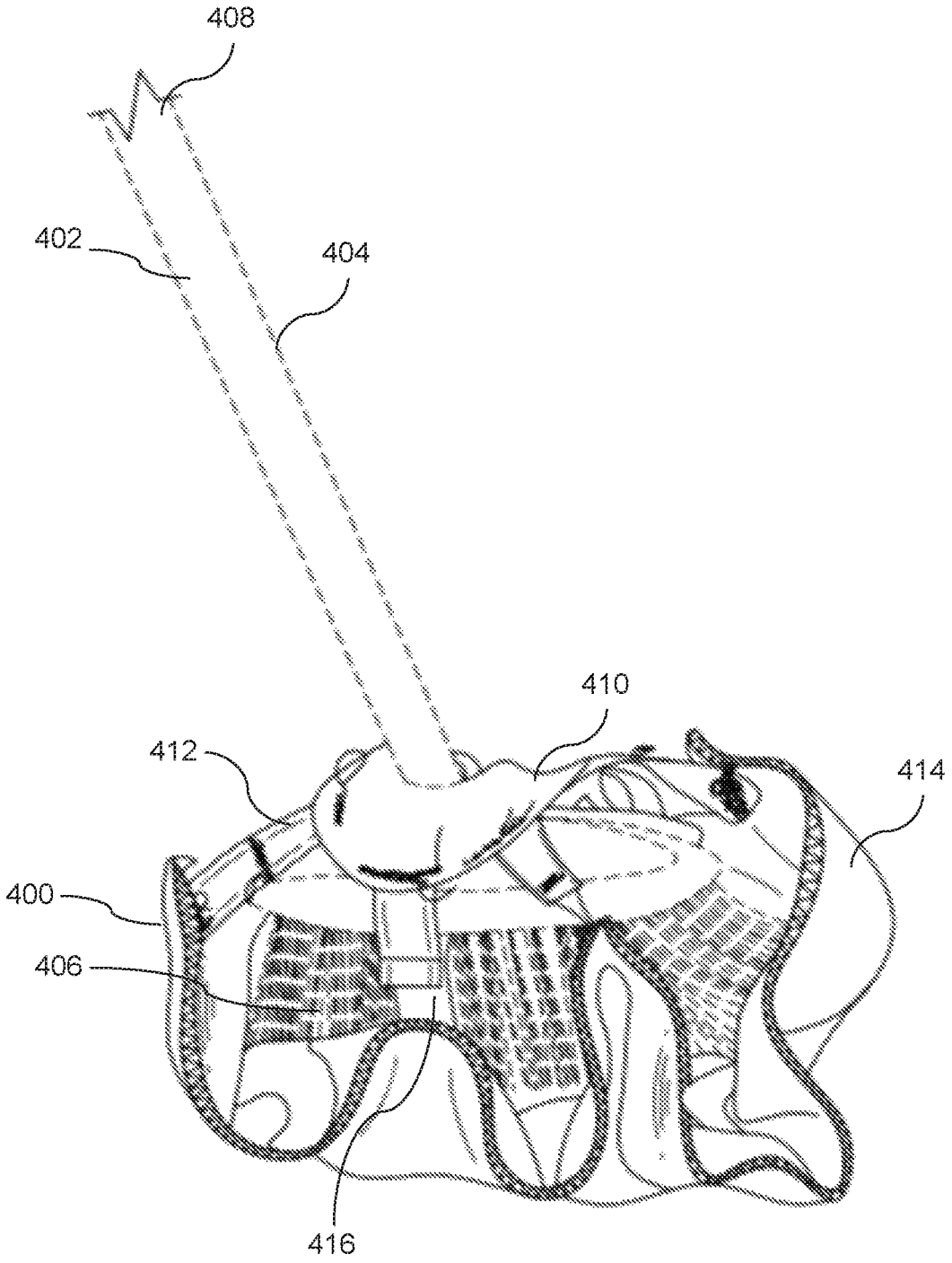
FIG. 4 is a block diagram illustrating an exemplary broom cover attachment attached to a broom, in accordance with an embodiment of the present disclosure.

FIG. 4 is a schematic diagram illustrating the exemplary broom cover attachment 400 attached to a broom 402, in accordance with an embodiment of the present disclosure. The broom 402 may include a handle 404 and a plurality of bristles 406 at a base of the handle 404. The broom cover attachment 400 may be used to cover the broom 402 for the purpose of dusting, sweeping or mopping hard surfaces.

The broom cover attachment 400 may include a handle attachment 410 comprising a plurality of elastic bands 412 extending outwards from a surface of the handle attachment 410. Each of the elastic bands 412 comprises a first attachment such as, but not limited to Velcro on at least one of an inner or an outer surface of the elastic bands 412. In some embodiments, a length of each of the elastic bands 412 is at least four inches. In some embodiments, the handle attachment 410 includes six elastic bands.

The central unit of the handle attachment 410 includes a hole. The central unit of the handle attachment 410 is substantially circular in shape. The diameter of the hole is at least one and half inches for allowing the broom handle 404 to enter through the hole. In some embodiments, the handle 404 may enter from a top 408 of the broom 402 into the handle attachment 410.

The broom cover attachment 400 also includes a cloth 414 or cloth cover 414 comprising a surface and a number of second attachments 416, such as Velcro, stitched onto the surface of the cloth 414. The cloth may include a microfiber cloth. In some embodiments, the number of second attachments is in accordance with the number of first attachments. After the handle attachment 410 is attached to the broom by entering from the top 408 of the handle 404, the second attachments 416 are fastened to the first attachments such that the surface of the cloth 414 covers substantially all the bristles 406 of the broom 402.

The broom 402 with the broom cover attachment 400 may be used to clean or dust the hard surfaces. Hence the users may not require any other cleaning device for cleaning of hard devices. Further, the disclosed broom cover attachment 400 may be used with almost every broom existing in the art. Further, the broom 402 being attached to the broom cover attachment 400 may be used to clean the surfaces efficiently.

The broom cover attachment 400 may not include any metal or other rigid material. Hence, the broom cover attachment 400 is convenient to remove and replace from the broom 402. Further, the broom cover attachment 400 comprises two parts and cloth part is detachable so if either of the part requires replacement, it's easy and not the whole broom cover attachment 400 need to be replaced, only that specific part can be replaced.

The handle attachment has six elastic bands that may make the broom cover attachment 400 more adaptable to a wider range of brooms of different sizes and shapes. Further, each of the elastic bands includes Velcro attachments for easy attachment, removal and replacement.

It will be appreciated that several of the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

The above description does not provide specific details of manufacture or design of the various components. Those of skill in the art are familiar with such details, and unless departures from those techniques are set out, techniques, known, related art or later developed designs and materials should be employed. Those in the art are capable of choosing suitable manufacturing and design details.

The terminology used herein is for the purpose of describing particular embodiments only and is not intended to be limiting of the disclosure. It will be appreciated that several of the above-disclosed and other features and functions, or alternatives thereof, may be combined into other systems, methods, or applications. Various presently unforeseen or unanticipated alternatives, modifications, variations, or improvements therein may subsequently be made by those skilled in the art without departing from the scope of the present disclosure as encompassed by the following claims.

What is claimed is:

1. A broom cover attachment for attaching to a broom comprising a plurality of bristles, comprising:

a handle attachment comprising a central unit, a hole in the central unit for receiving a handle of the broom, and a plurality of elastic bands attached to a surface between an outer circumference and an inner circumference of the central unit, wherein each of the plurality of elastic bands comprises a first Velcro attachment;

a cloth comprising a plurality of second Velcro attachment attached to a surface of the cloth, the plurality of second Velcro attachment is configured to be fastened to the first Velcro attachment of the plurality elastic bands for covering the plurality of bristles of the broom.

2. The broom cover attachment of claim 1, wherein the central unit of the handle attachment is circular in shape.

3. The broom cover attachment of claim 2, wherein a diameter of the central unit is at least four inches.

4. The broom cover attachment of claim 3, wherein a diameter of the hole is at least one and half inches for allowing a broom handle to enter through the hole.

5. The broom cover attachment of claim 4, wherein the plurality of elastic bands comprises at least six elastic bands.

6. The broom cover attachment of claim 5, wherein the cloth comprises a microfiber cloth.

7. The broom cover attachment of claim 6, wherein the plurality of second Velcro attachment comprises at least six second Velcro attachment attached to the surface of the cloth configured to enable an easy attachment and removal of the cloth from the handle attachment.

8. A broom cover attachment for attaching to a broom comprising a plurality of bristles, comprising:

a handle attachment comprising a hole in a circular central unit for receiving a handle of the broom, and at least six elastic bands attached to a surface between an outer circumference and an inner circumference of the circular central unit, wherein each of the at least six elastic bands comprises a first attachment;

a microfiber cloth comprising at least six second attachment, the at least six second attachment are configured to be fastened to the first attachment of the plurality elastic bands for covering the plurality of bristles of the broom.

9. The broom cover attachment of claim 8, wherein a diameter of the circular central unit of the handle attachment is at least four inches.

10. The broom cover attachment of claim 9, wherein a diameter of the hole is at least one and half inches.

11. The broom cover attachment of claim 10, wherein the first attachment comprising at least one of a Velcro, one or more tying threads, and a button.

12. The broom cover attachment of claim 11, wherein the second attachment comprising at least one of a Velcro, one or more tying threads, and a button.

13. A method for using a broom comprising a plurality of bristles, comprising:

providing a broom cover attachment comprising a handle attachment comprising a central unit, a hole in a center of the central unit, and a plurality of elastic bands attached to a surface between an outer circumference and an inner circumference of the handle attachment, wherein each of the plurality of elastic bands comprises a first attachment, and a cloth comprising a plurality of second attachment; and attaching the broom cover attachment to the broom by entering the handle of the broom in the hole and fastening the plurality of second attachment of the cloth to the first attachment of the plurality elastic bands such that the plurality of bristles of the broom are covered with the cloth.

14. The method of claim 13, wherein the central unit of the handle attachment is circular in shape.

15. The method of claim 14, wherein a diameter from a center of the hole to the outer circumference of the central unit is at least four inches.

16. The method of claim 15, wherein a diameter of the hole is at least one and half inches.

17. The method of claim 16, wherein the plurality of elastic bands comprises at least six elastic bands.

18. The method of claim 17, wherein the cloth comprises a microfiber cloth.

19. The method of claim 18, wherein the plurality of second attachment comprises at least six second attachments attached to the surface of the cloth for enabling easy attachment to and removal from the handle attachment.

20. The method of claim 19, wherein the first attachment and the second attachment comprising at least one of a Velcro, one or more tying threads, and a button.

* * * * *